US009039437B2

(12) United States Patent
Kurumizawa

(10) Patent No.: US 9,039,437 B2
(45) Date of Patent: May 26, 2015

(54) LOCK DEVICE

(71) Applicant: KABUSHIKI KAISHA TOKAI RIKA DENKI SEISAKUSHO, Aichi (JP)

(72) Inventor: Naoto Kurumizawa, Aichi (JP)

(73) Assignee: KABUSHIKI KAISHA TOKAI RIKA DENKI SEISAKUSHO, Aichi (JP)

( * ) Notice: Subject to any disclaimer, the term of this patent is extended or adjusted under 35 U.S.C. 154(b) by 28 days.

(21) Appl. No.: 14/098,732

(22) Filed: Dec. 6, 2013

(65) Prior Publication Data

US 2014/0170890 A1 Jun. 19, 2014

(30) Foreign Application Priority Data

Dec. 13, 2012 (JP) ..... 2012-272496

(51) Int. Cl.
*H01R 13/639* (2006.01)
*H01R 13/703* (2006.01)

(52) U.S. Cl.
CPC ..... *H01R 13/6397* (2013.01); *H01R 13/7031* (2013.01); *H01R 2201/26* (2013.01)

(58) Field of Classification Search
CPC ..... H01R 13/6397; H01R 13/6275; H01R 13/62933; H01R 13/629; H01R 13/6272; H01R 2201/26; G07C 9/0096; E05B 47/0012
See application file for complete search history.

(56) References Cited

U.S. PATENT DOCUMENTS 4,685,709 A * 8/1987 Kambic ..... 292/201
5,344,330 A * 9/1994 Hoffman ..... 439/138
5,629,627 A * 5/1997 Hoshino et al. ..... 324/538
5,862,692 A * 1/1999 Legault et al. ..... 70/278.1
6,279,361 B1 * 8/2001 Baukholt et al. ..... 70/279.1
7,040,912 B2 * 5/2006 Mimoto et al. ..... 439/352
7,386,868 B2 * 6/2008 McCormack ..... 720/657
8,523,589 B2 9/2013 Kurumizawa et al.
8,602,804 B2 12/2013 Kurumizawa et al.
8,616,909 B2 12/2013 Kurumizawa et al.
8,678,847 B2 * 3/2014 Inoue et al. ..... 439/352
2006/0042334 A1 * 3/2006 Huang ..... 70/279.1
2008/0303290 A1 * 12/2008 Yuan ..... 292/195
2013/0015951 A1 1/2013 Kuramochi et al.
2013/0040486 A1 2/2013 Kurumizawa et al.
2013/0047687 A1 2/2013 Kurumizawa et al.
2013/0078840 A1 * 3/2013 Inoue et al. ..... 439/345
2013/0255333 A1 10/2013 Kurumizawa et al.
2013/0260595 A1 * 10/2013 Tamaki et al. ..... 439/345
2013/0260597 A1 10/2013 Kurumizawa et al.
2014/0045360 A1 * 2/2014 Toratani et al. ..... 439/345

FOREIGN PATENT DOCUMENTS

JP 2009-081917 4/2009

* cited by examiner

*Primary Examiner* — Gary Paumen
(74) *Attorney, Agent, or Firm* — Greenblum & Bernstein, P.L.C.

(57) ABSTRACT

A lock device locks a locking subject and includes a lock member moved between a lock position for locking the locking subject and an unlock position for unlocking the locking subject. A first urging member urges the lock member to the lock position. A switching member moves between a first position where the switch member fixes the lock member at the lock position and a second position where the switch member permits the lock member to unlock the locking subject. A first actuator drives the switching member. A position detector is arranged in a power supply line connected to the first actuator. The position detector detects whether the lock member has been moved from the unlock position to the lock position subject and permits the supply of power to the first actuator when detecting the movement.

7 Claims, 7 Drawing Sheets

LOCK DEVICE

CROSS-REFERENCE TO RELATED APPLICATIONS

This application is based upon and claims the benefit of priority from prior Japanese Patent Application No. 2012-272496, filed on Dec. 13, 2012, the entire contents of which are incorporated herein by reference.

BACKGROUND ART

The present invention relates to a lock device for locking and unlocking a locking subject related to a power port.

Vehicles that emit less carbon dioxide, such as plugin hybrid vehicles and electric vehicles, are environment-friendly and have become popular. Such a vehicle is powered by a battery. When the battery drains after driving the vehicle over a long distance, the battery is recharged. The body of the vehicle is provided with a power port used to charge the battery. A charge cable of a charging facility is connected to the power port to supply power from the charging facility and charge the battery. The battery charging takes a long time. Thus, a charge cable lock device may be used to lock the charge cable to the vehicle body and prevent theft of the charge cable. Japanese Laid-Open Patent Publication No. 2009-081917 describes an example of such a charge cable lock device.

The charge cable lock device may lock and unlock the charge cable in cooperation with the locking and unlocking of the vehicle doors. However, when the charge cable locking is performed in cooperation with the door locking, the charge cable lock device may function in cooperation with the locking and unlocking of the vehicle doors even when the charge cable is not connected to the inlet. This may shorten the life of the lock device.

SUMMARY OF THE INVENTION

One aspect of the present invention is a lock device for locking a locking subject. The lock device includes a lock member that moves between a lock position where the lock member locks the locking subject and an unlock position where the lock member unlocks the locking subject. A first urging member constantly urges the lock member to the lock position. A switching member moves between a first position where the switch member fixes the lock member at the lock position and a second position where the switch member permits the lock member to unlock the locking subject. A first actuator drives the switching member. A position detector is arranged in a power supply line connected to the first actuator. The position detector detects whether or not the lock member has been moved from the unlock position to the lock position by the locking subject and permits power to be supplied to the first actuator when detecting the movement.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE INVENTION

A lock device according to one embodiment of the present invention will now be described with reference to FIGS. 1 to 11.

Outline of Charge System

Figure 1:
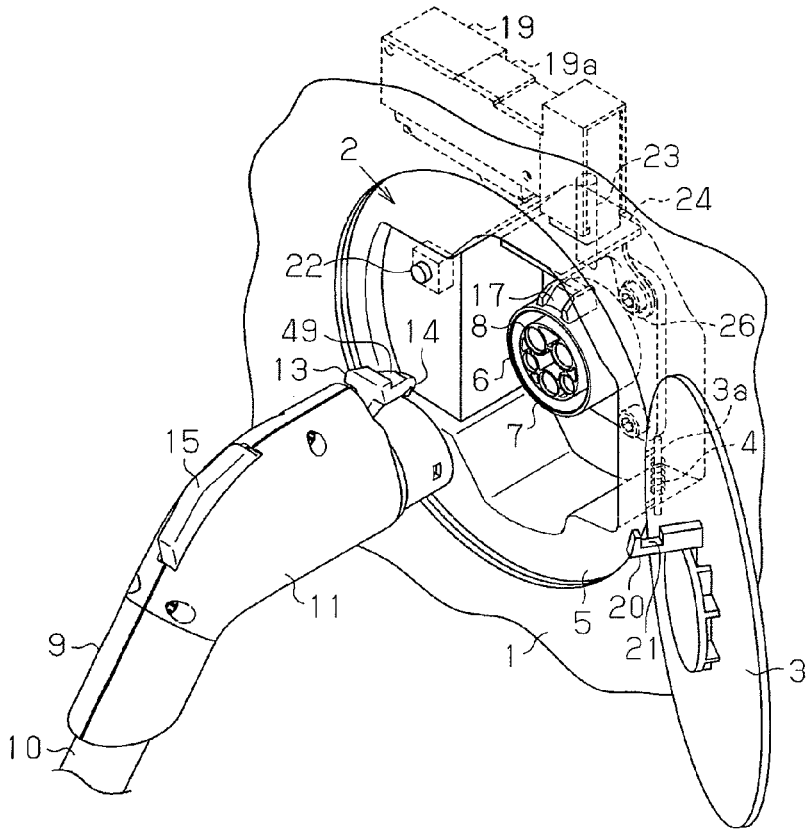
FIG. 1 is a perspective view showing a power port in one embodiment.

Referring to FIG. 1, a vehicle such as a plugin hybrid vehicle includes a charge system that allows for a battery (not shown) of the vehicle to be charged by an external power supply installed in a household, charging station, or the like. The body 1 of the vehicle has a side wall including a power port 2. A lid 3 opens and closes the power port 2. The lid 3 is pivotal about a shaft 3*a*, which extends in the vertical direction. An urging member 4, such as a torsion spring, is arranged on the shaft 3*a* to urge the lid to an open position. An inlet 6, which serves as a power receiving connector, is arranged at the middle of a lid box 5 in the power port 2. The inlet 6 includes a cylindrical inlet case 7, a terminal portion 8 arranged in the inlet case 7, and a catch 17 arranged on the inlet case 7. The lid 3 corresponds to a locking subject.

Figure 2:
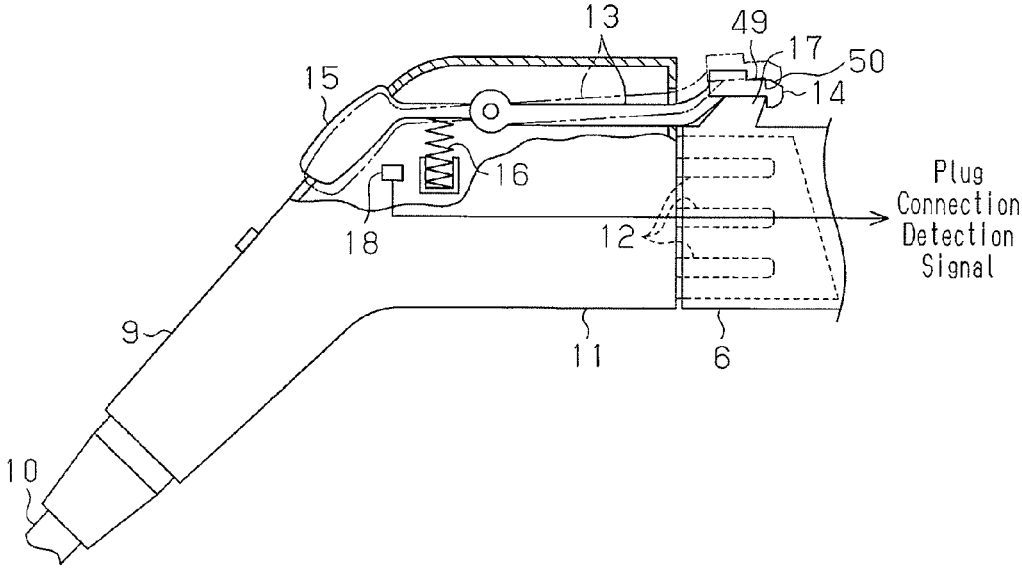
FIG. 2 is a diagram showing the connection of a charge cable to an inlet.

Referring to FIG. 2, a charge cable 9 extending from an external power supply is connectable to the inlet 6. The charge cable 9 includes a cable portion 10 and a power plug 11, which is arranged on the distal end of the cable portion 10 and serves as a power supplying connector. A terminal portion 12 is arranged on the distal end of the power plug 11 in correspondence with the terminal portion 8 of the inlet 6. A lock arm 13 is pivotally coupled to the power plug 11 to hold the power plug 11 on the inlet 6. The lock arm 13 is pivoted between a hold position, where the power plug 11 is held on the inlet 6, and a release position, where the power plug 11 is released from the inlet 6. The lock arm 13 includes a hook 14, which is arranged on the distal end of the lock arm 13, and an arm operation portion 15, which is arranged on the basal end of the lock arm 13. The hook 14 and the arm operation portion 15 are exposed to the exterior. An urging member 16 is arranged on the lock arm 13 near the arm operation portion 15 to constantly urge the lock arm 13 to a lock position. The charge cable 9 corresponds to a locking subject.

When the power plug 11 is connected to the inlet 6, the power plug 11 is fitted straight to the inlet 6. Then, the hook 14 comes into contact with a sloped surface of the catch 17 on the inlet cases 7. This lifts the hook 14. After the hook 14 moves over the sloped surface, the power plug 11 is fully fitted to the inlet 6. Then, the urging force of the urging member 16 pivots the lock arm 13 to a hold position. As a result, the hook 14 is hooked to the catch 17, and the power plug 11 is held by the inlet 6.

A plug connection detector 18 is arranged in the power plug 11 to detect connection of the charge cable 9 to the inlet 6. When the charge cable 9 is connected to the inlet 6 and the hook 14 is hooked to the catch 17, the plug connection detector 18 detects that the lock arm 13 is located at the hold position. When the plug connection detector 18 detects that the lock arm 13 is located at the hold position, the plug connection detector 18 provides a plug connection detection signal, which indicates that the power plug 11 is connected to the inlet 6, to the vehicle body 1 via the terminal portions 8 and 12.

Structure of Lock Device

Figure 3:
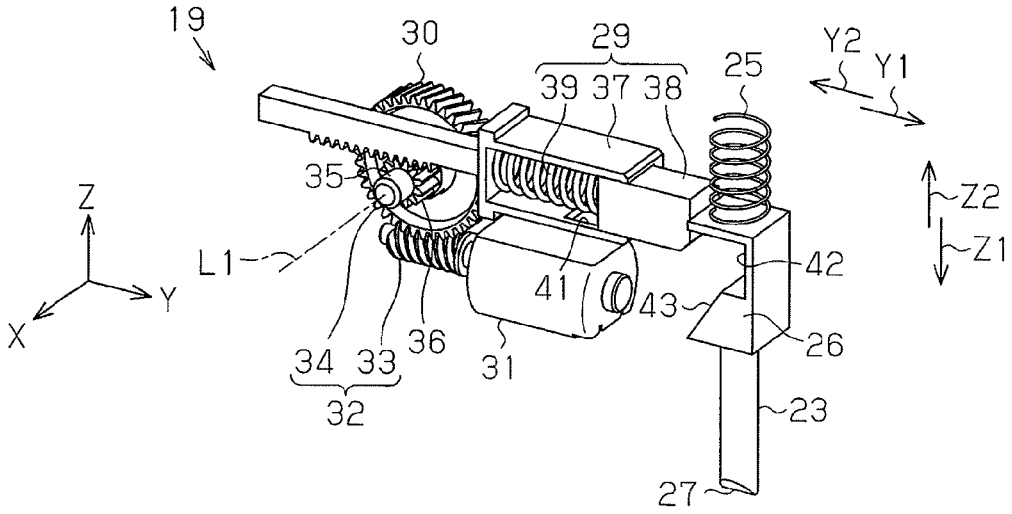
FIG. 3 is a perspective view showing the internal structure of a lock device.

As shown in FIGS. 1 and 3, the power port 2 includes a lock device 19 capable of locking both of the lid 3 and the charge cable 9. In other words, the lock device 19 of the present example is of an integrated type in which a lid lock device and a charge cable lock device share the same actuator. A striker 20 projects from a rear surface of the lid 3. The lock device 19 engages the striker 20 when locking the lid 3. An engagement groove 21 having a predetermined depth is formed in the distal end of the striker 20. A trigger switch 22 is arranged in the power port 2. The trigger switch 22 may be of a push type. The trigger switch 22 is capable of detecting, for example, the opening and closing of the lid 3 or further inward pushing of the lid 3 from a closed position.

Figure 4A:
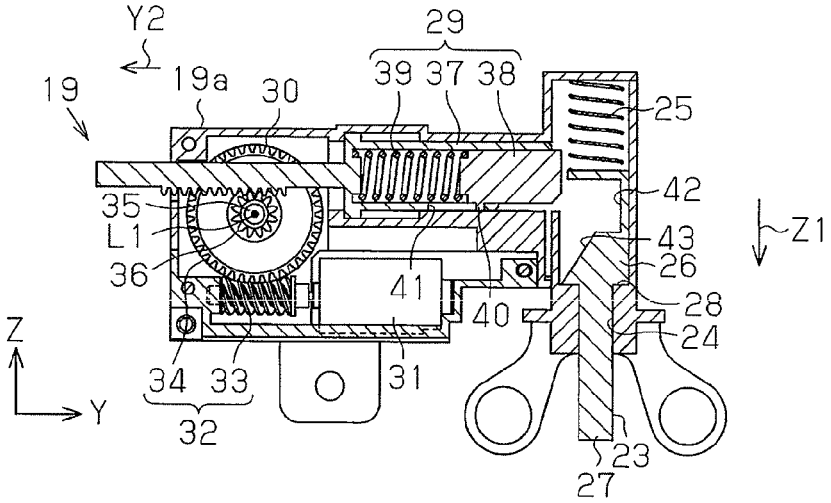
FIG. 4A is a cross-sectional view showing the lock device in an unlock state.
Figure 4B:
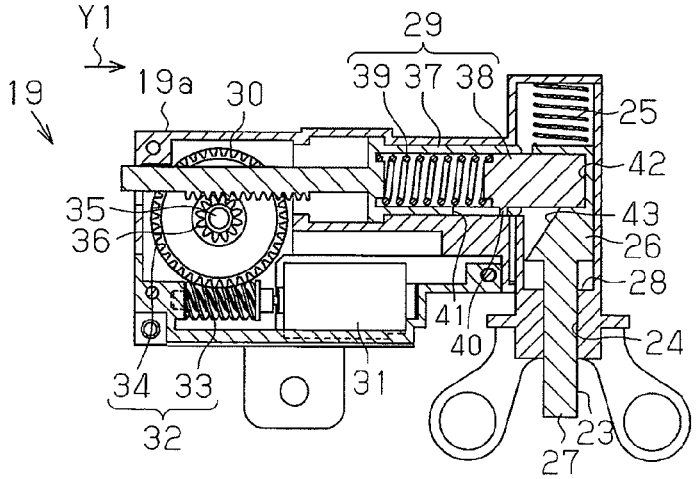
FIG. 4B is a cross-sectional view showing the lock device in a lock state.

As shown in FIGS. 4A and 4B, the lock device 19 includes a housing 19*a* that accommodates a lock pin 23, which is engageable with the lid 3 and the power plug 11. The lock pin 23 is movable back and forth in its longitudinal direction (Z axis direction in FIG. 4A). For example, the housing 19*a* includes a pin accommodation portion 24. A lock pin 23 is movably arranged in the pin accommodation portion 24. A step is formed in a longitudinally middle part of the pin accommodation portion 24. An urging member 25 is arranged between an inner wall of the housing 19*a* and the lock pin 23 to constantly urge the lock pin 23 in a lock direction (direction of arrow Z1 in FIG. 4A). In this manner, the lock device 19 of the present example is a constantly locking urging mechanism. In the lock device 19 of the present example, the urging member 25 constantly urges the lock pin 23 so that the lock pin 23 locks either one of the lid 3 and the power plug 11. For example, a coil spring is used as the urging member 25. The lock pin 23 corresponds to a lock member.

The lock pin 23 is generally pin-shaped and includes a head 26 having a large diameter and a shaft 27 having a smaller diameter than the head 26. The head 26 of the lock pin 23 is caught and held on a step 28 in the pin accommodation portion 24.

The lock device 19 includes a link 29 that permit and prohibits movement of the lock pin 23. The link 29 is movable back and forth in its longitudinal direction (Y axis direction in FIG. 4A). More specifically, the link 29 moves between a first position where the link 29 fixes the lock pin 23 at a lock position, and a second position where the link 29 permits the lock pin 23 to unlock the locking subjects 3 and 9. A wheel 30 connects the link 29 to a lock motor 31. A worm gear 32 couples a motor shaft of the lock motor 31 to the wheel 30. The worm gear 32 includes a worm 33, which is formed on the motor shaft, and a worm wheel 34, which is formed by the wheel 30. The link 29 corresponds to a switching member, and the lock motor 31 corresponds to an actuator (first actuator).

A shaft 35 including a pinion 36 extends from the wheel 30. The pinion 36 rotates integrally and coaxially with the wheel 30. The pinion 36 is coupled to the link 29. The link 29 includes a rack 37, which is engaged with the pinion 36, an engagement pin 38, which is fitted to the rack 37, and an urging member 39, which is arranged between the rack 37 and the engagement pin 38. The urging member 39 may be, for example, a coil spring. A structure including, for example, a projection 40 and an elongated hole 41 couple the rack 37 and the engagement pin 38. The drive force generated by the lock motor 31 rotates the wheel 30 about the axis L1 of the cylindrical shaft 35. The rotation of the wheel 30 moves the link 29 in a direction (Y axis direction in FIG. 4A) that is perpendicular to the moving direction of the lock pin 23 (Z axis direction in FIG. 4A). The rack 37 corresponds to a support member, and the engagement pin 38 corresponds to an engagement member.

The head 26 of the lock pin 23 includes a groove 42 that can receive the engagement pin 38. When the engagement pin 38 is engaged with the groove 42, movement of the lock pin 23 is disabled in the vertical direction (Z direction in FIG. 4A). Further, the side surface of the head 26 defines a guide slope 43 that guides the engagement pin 38, which is forced to the lock side (toward the lock pin 23), into the groove 42. Thus, when the engagement pin 38 and the groove 42 are not correctly engaged and the engagement pin 38 is in contact with the guide slope 43, the urging force of the urging member 39 pushes the engagement pin 38 against the guide slope 43, which guides the engagement pin 38 into the groove 42. The groove 42 corresponds to an engaged portion.

As shown in FIG. 4A, when the lock motor 31 generates rotation in one direction and moves the link 29 in an unlock direction (direction of arrow Y2 in FIG. 4A facing away from lock pin 23), the engagement pin 38 is separated from the groove 42 of the lock pin 23. This permits movement of the lock pin 23 and allows for the lock pin 23 to move back and forth between the lock position and the unlock position while receiving urging force in the lock direction. Under this situation, the lock device 19 is in an unlock state and permits movement of the lock pin 23.

As shown in FIG. 4B, when the lock motor 31 generates rotation in the other direction and moves the link 29 in a lock direction (direction of arrow Y1 in FIG. 4B facing toward lock pin 23), the engagement pin 38 is engaged with the groove 42 of the lock pin 23. This prohibits movement of the lock pin 23 so that the lock pin 23 cannot move along its longitudinal direction. Under this situation, the lock device 19 is in a lock state and prohibits movement of the lock pin 23.

Figure 5:
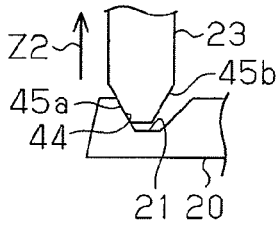
FIG. 5 is a side view of a striker and a lock pin.

As shown in FIG. 5, the engagement groove 21 of the striker 20 includes a lifting slope 44 that lifts the lock pin 23 in a direction facing away from the engagement groove 21 (direction of arrow Z2 in FIG. 5) when opening the lid 3. Further, opposite sides on the distal end of the lock pin 23 form two chamfered portions 45*a* and 45*b*. When opened, the lid 3 is first slightly lifted by the urging member 4 and then manually opened. However, the urging member 4 may be omitted and the lid 3 may be opened only manually. Alternatively, the lid 3 may be opened by a push lifter.

Structure for Connecting Electric Components of Lock Device

Figure 6:
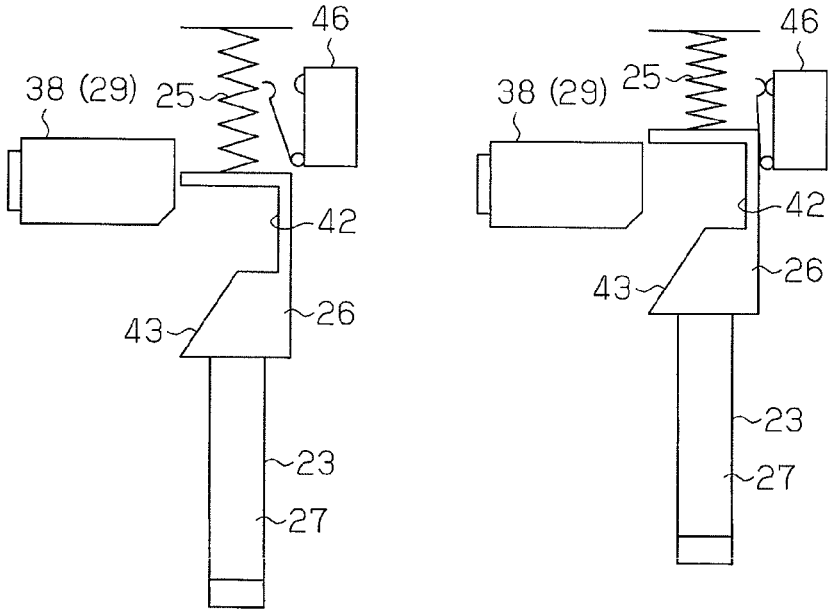
FIG. 6 is a schematic diagram showing a constantly locking urging mechanism.

Referring to FIG. 6, a lock pin detection switch 46 is arranged in the movement path of the lock pin 23 to detect whether or not the lock pin 23 is located at a lifted position. The lock pin detection switch 46 may be, for example, a microswitch. The lock pin detection switch 46 is deactivated when the engagement pin 38 is free and not engaged with the lock pin 23. The lock pin detection switch 46 is activated when the lock pin 23 is lifted against the urging force of the urging member 25 by, for example, the lock arm 13 or the striker 20. The lock pin detection switch 46 corresponds to a position detector.

The coupling position of the lock pin detection switch 46 is set so that the lock pin detection switch 46 is activated when the lock pin 23 is lifted by a predetermined amount. Thus, the lock pin detection switch 46 may be activated when the lock pin 23 is slightly lifted or when the lock pin 23 is lifted for a relatively large amount. In any case, the lock pin detection switch 46 detects the lock pin 23 when lifted.

Figure 7:
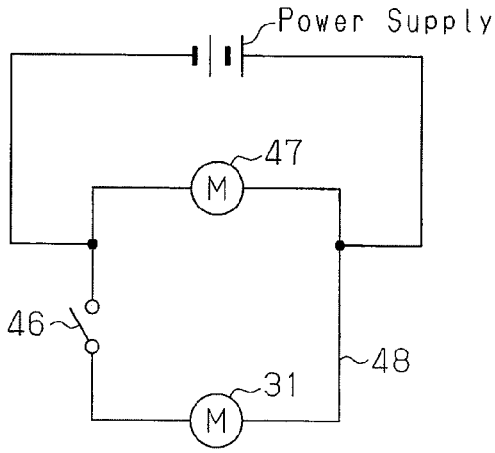
FIG. 7 is a motor circuit diagram of the lock device.

Referring to FIG. 7, the lock motor 31 is connected in parallel to a door lock motor 47, which serves as a drive source for locking and unlocking a door. The lock pin detection switch 46 is connected to a wire connected to a motor circuit 48 of the lock motor 31. The lock pin detection switch 46 is located, for example, between a connection point shared by the lock motor 31 and the power supply of the door lock motor 47. The lock pin detection switch 46 is arranged in a power supply line connected to the lock motor 31 and detects whether the lock pin 23 has been moved from the unlock position to the lock position by the locking subject 3 or 9. The lock pin detection switch 46 permits the supply of power to the lock motor 31 when movement to the lock position is detected. Thus, when current flows to the door lock motor 47 and the lock pin detection switch 46 is activated, the current also flows to the lock motor 31. That is, the lock device 19 cooperates with the door locking action. The motor circuit 48 of the present example may be installed just by connecting the motor circuit 48 in parallel to a conventional door lock device (separate device). The door lock motor 47 corresponds to a second actuator, and the motor circuit 48 corresponds to an actuator circuit.

The operation of the lock device 19 in the present example will now be described with reference to FIGS. 8 to 11. To simplify the drawings, in FIGS. 8 to 11, the engagement pin 38 is shown engaged with the groove 42 of the lock pin 23, and the engagement pin 38 is shown on the lock pin 23.

Lid Unlock Operation

Figure 8:
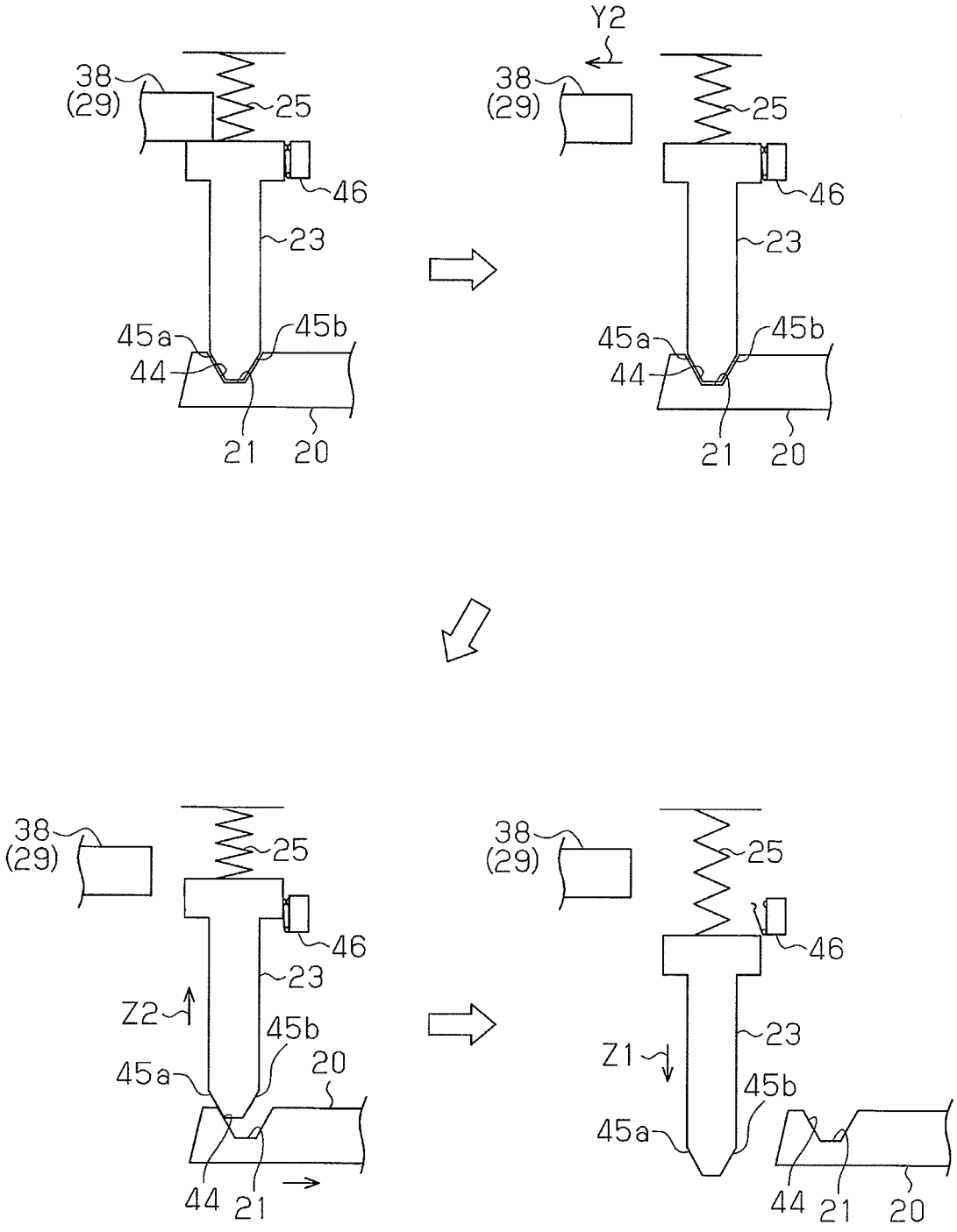
FIG. 8 is a schematic diagram illustrating a lid unlocking operation.

As shown in FIG. 8, when the lid 3 is located at a close position, the lock pin 23 is engaged with the engagement groove 21 of the striker 20, and the groove 42 of the lock pin 23 of the lock pin 23 is engaged with the engagement pin 38. In this case, the lock pin 23 is fixed, and the lid 3 is locked. This prohibits opening of the lid 3. Thus, the lid 3 cannot be opened.

When the lid 3 is locked, the striker 20 lifts the lock pin 23 by a predetermined amount to a lifted position. This activates the lock pin detection switch 46 and closes the motor circuit 48. Thus, when unlocking the vehicle door, current flows in the unlock direction to the door lock motor 47, and some of the current flows to the lock motor 31 so that the lock motor 31 generates rotation in the unlock direction. This moves the engagement pin 38 in the unlock direction (direction of arrow Y2 in FIG. 8 facing away from the lock pin 23) away from the groove 42 of the lock pin 23, and the lock pin 23 becomes free. In this manner, the lid 3 is unlocked, and opening of the lid 3 is permitted.

When the lid 3 is manually opened, the lifting slope 44 of the striker 20 first pushes the chamfered portion 45*a* of the lock pin 23 and lifts the lock pin 23 in a removal direction (direction of arrow Z2 in FIG. 8). When the lid 3 fully opens, the urging force of the urging member 25 moves the lock pin 23 straight in the projection direction (direction of arrow Z1 in FIG. 8). This frees the lock pin 23 again, deactivates the lock pin detection switch 46, and opens the motor circuit 48. Thus, even when a door is locked or unlocked, current does not flow to the lock motor 31, and the lock device 19 is not operated.

Charge Cable Lock Operation

Figure 9:
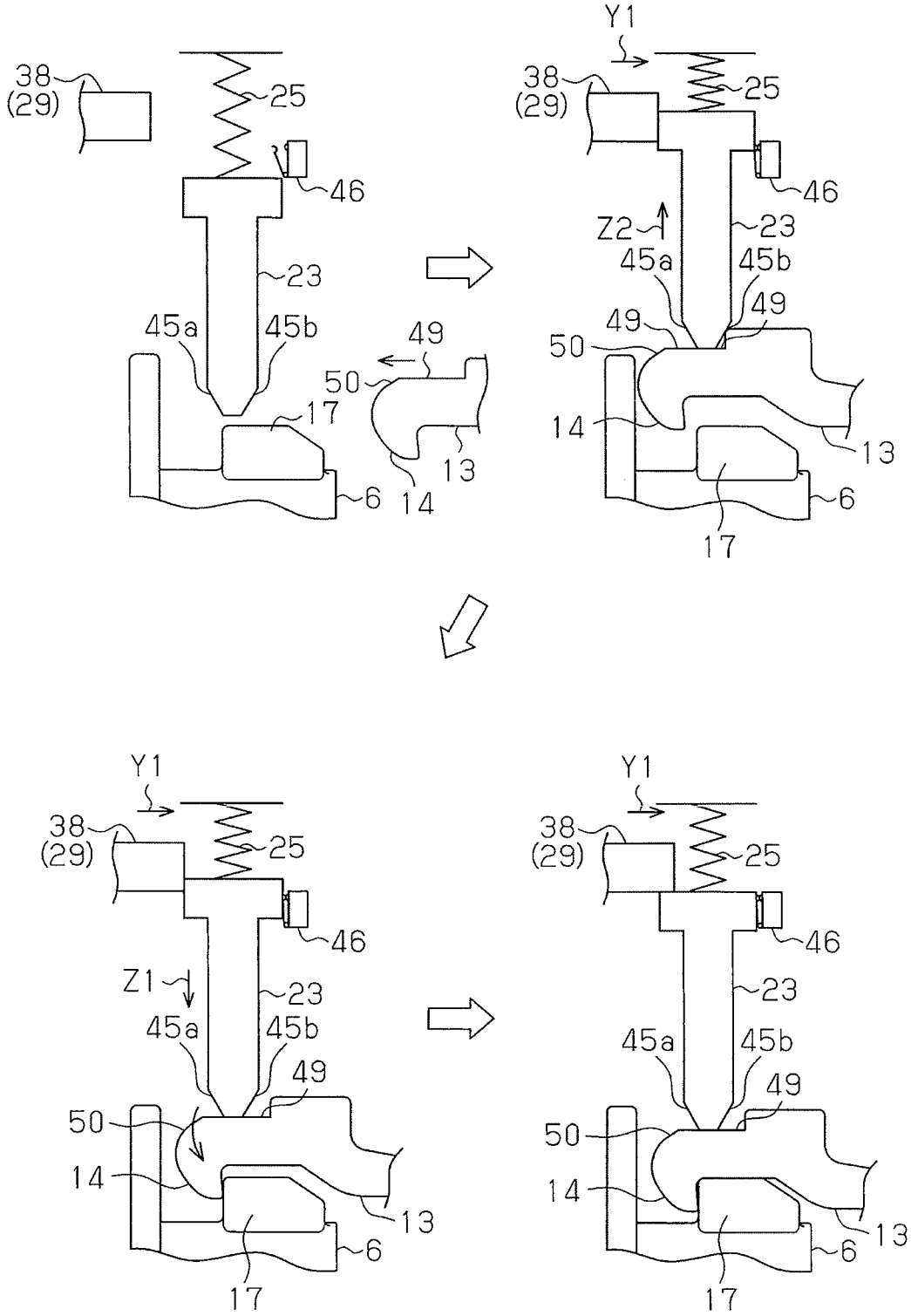
FIG. 9 is a schematic diagram illustrating a charge cable locking operation.

As shown in FIG. 9, when the charge cable 9 is unlocked, the lock pin 23 is located at the unlock position and is free. Thus, the lock pin detection switch 46 is deactivated. This closes the motor circuit 48. Under this situation, when connecting the charge cable 9 to the inlet 6, a lifting slope 50 at the distal end of the lock arm 13 lifts the chamfered portion 45*b* of the lock pin 23 in the removal direction (direction of arrow Z2 in FIG. 9). Thus, the lock pin 23 that is located at the lifted position activates the lock pin detection switch 46 and closes the motor circuit 48.

When locking the vehicle door, current flows in the lock direction to the door lock motor 47, and some of the current flows to the lock motor 31 so that the lock motor 31 generates rotation in the lock direction. Thus, the engagement pin 38 moves in the lock direction (direction of arrow Y1 in FIG. 9). In this case, even if the lock pin 23 excessively moves away from the lock arm 13, while permitting movement of the rack 37 toward the lock side with the urging member 39, the engagement pin 38 comes into contact with the guide slope 43 of the lock pin 23.

Then, when the hook 14 of the lock arm 13 becomes hooked to the catch 17 of the inlet 6, the engagement pin 38 moves to push the guide slope 43 and move the lock pin 23 in the projection direction (direction of arrow Z1 in FIG. 9). The lock pin 23 follows the movement of the lock arm 13 in the closing direction. Then, when the hook 14 is fully hooked to the catch 17, the lock pin 23 comes into contact with an abutment surface 49 defined on the upper surface of the lock pin 23. Further, the engagement pin 38 fixes the lock pin 23. This locks the charge cable 9 so that the charge cable 9 cannot be removed from the inlet 6.

Charge Cable Unlock Operation

Figure 10:
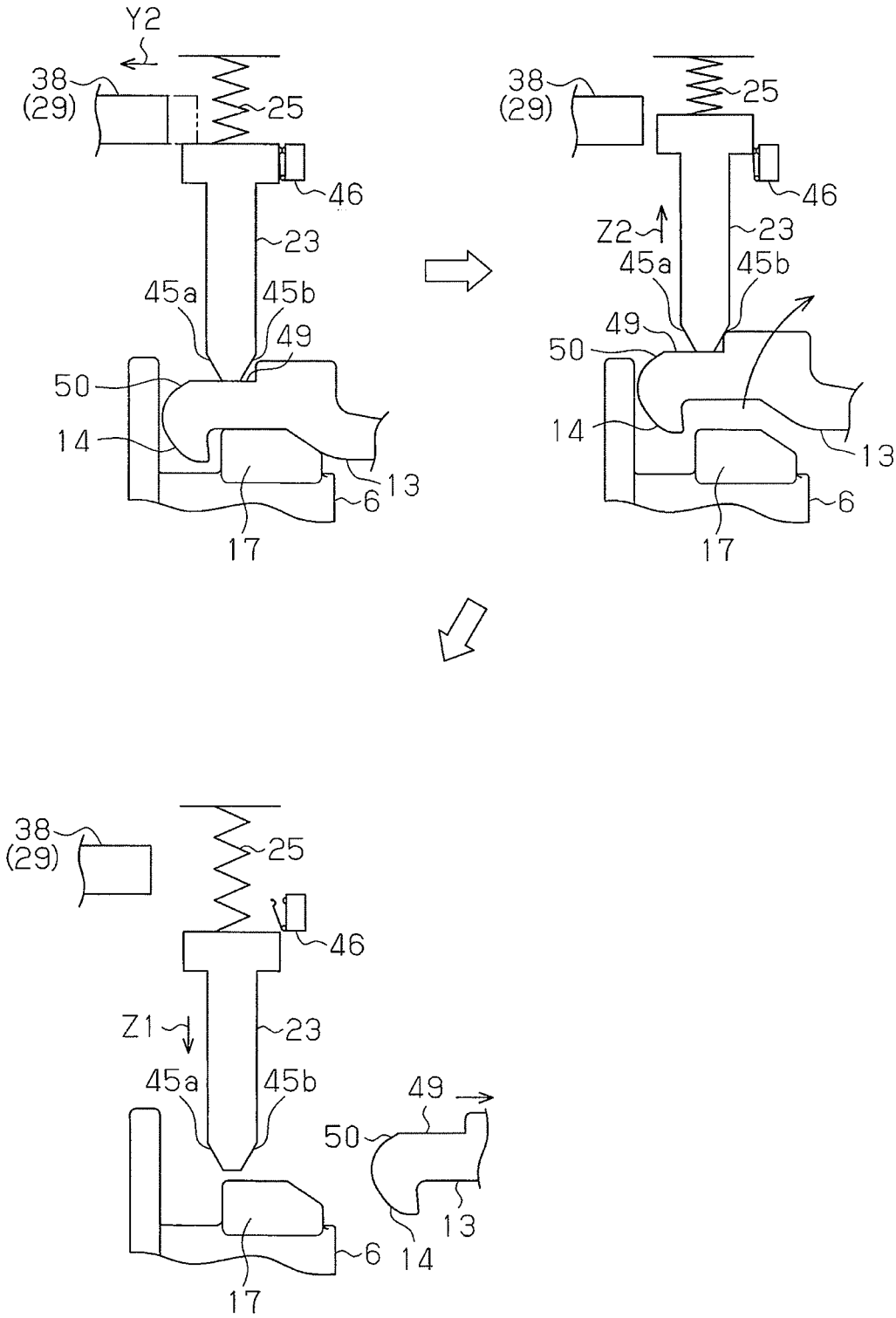
FIG. 10 is a schematic diagram illustrating a charge cable unlocking operation.

As shown in FIG. 10, when the charge cable 9 is locked, the lock pin 23 is held at a lifted position by the lock arm 13. This activates the lock pin detection switch 46 and closes the motor circuit 48. Thus, when unlocking the vehicle door, current flows in the unlock direction to the door lock motor 47, and some of the current flows to the lock motor 31 so that the lock motor 31 generates rotation in the unlock direction. Thus, the engagement pin 38 moves in the unlock direction (direction of arrow Y2 in FIG. 10) away from the groove 42 of the lock pin 23. This frees the lock pin 23. In other words, the charge cable 9 is unlocked, and removal of the charge cable 9 is permitted.

Then, the power plug 11 is gripped to pivot the lock arm 13 to a release position so that the abutment surface 49 of the hook 14 lifts the lock pin 23 in the removal direction (direction of arrow Z2 in FIG. 10). Under this situation, the charge cable 9 is pulled out and removed from the inlet 6. When the charge cable 9 is removed from the inlet 6, the urging force of the urging member 25 pushes the lock pin 23 in the projection direction (direction of arrow Z1 in FIG. 10) and deactivates the lock pin detection switch 46 again.

Lid Lock Operation

Figure 11:
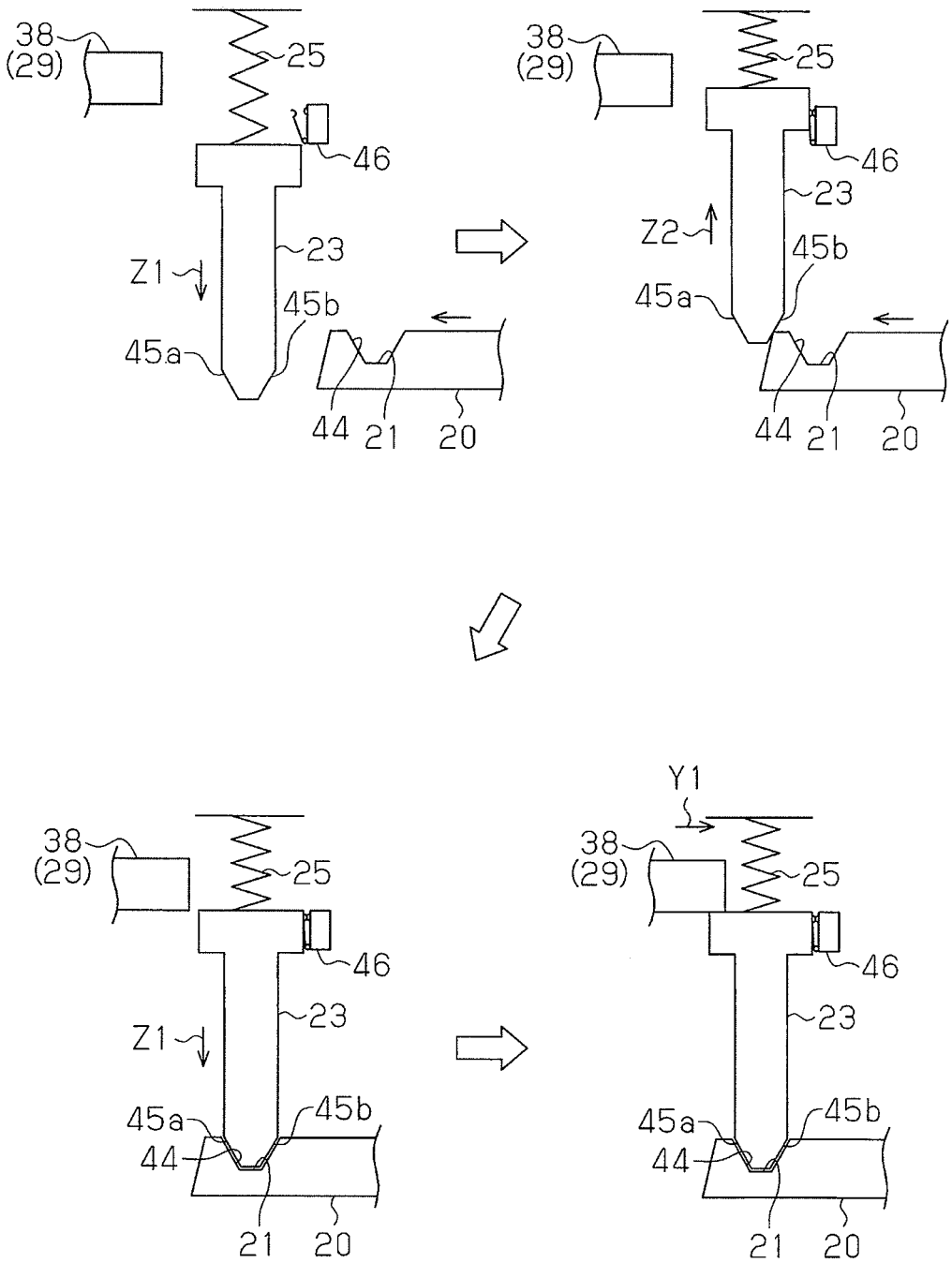
FIG. 11 is a schematic diagram illustrating a lid locking operation.

As shown in FIG. 11, when the lid 3 is unlocked, the lock pin 23 is located at the unlock position and free. This deactivates the lock pin detection switch 46 and closes the motor circuit 48. Under this situation, when closing the lid 3, the distal portion of the striker 20 lifts the chamfered portion 45*b* of the lock pin 23 in the removal direction (direction of arrow Z2 in FIG. 11). The lock pin 23 that is located at the lifted position activates the lock pin detection switch 46 and closes the motor circuit 48. Then, when the lid 3 is fully closed, the urging force of the urging member 25 moves the lock pin 23 in the projection direction (direction of arrow Z1 in FIG. 11), and the lock pin 23 is engaged with the engagement groove 21 of the striker 20.

Subsequently, when locking the vehicle door, current flows in the lock direction to the door lock motor 47, and some of the current flows to the lock motor 31 so that the lock motor 31 generates rotation in the lock direction. Thus, the engagement pin 38 moves in the lock direction (direction of arrow Y1 in FIG. 11) and engages the groove 42 of the lock pin 23 so that the lock pin 23 fixes the engagement pin 38. In other words, the lid 3 is locked, and unauthorized opening of the lid 3 is prohibited.

The present embodiment has the advantages described below.

(1) The lock device 19 has a constantly locking urging structure, and the lock pin 23 lifted by the lock arm 13 or the striker 20 may be detected by the lock pin detection switch 46. When the lifting of the lock pin 23 activates the lock pin detection switch 46, the motor circuit 48 closes, and the current flowing to the door lock motor 47 when locking or unlocking the vehicle door drives the lock motor 31 so that the lock device 19 performs locking or unlocking. Thus, even though the locking and unlocking operations of the lock device 19 are performed in cooperation with the door locking, the lock device 19 is not operated unless the lid 3 or the charge cable 9 is connected to the power port 2. Thus, the lock device 19 does not perform unnecessary operations. This increases the durability of the device.

(2) The lock motor 31 is connected parallel to the door lock motor 47, and the current flowing to the door lock motor 47 when performing a door locking operation drives the lock motor 31. Thus, the current flowing to the door lock motor 47 functions as a power supply for the lock motor 31, and there is no need to prepare a separate power supply.

(3) The lock pin 23, which is moved between the lock position and the unlock position by the lock motor, is a single component shared for locking the charge cable 9 and locking the lid 3. Thus, there is no need for the charge cable 9 and the lid 3 to be provided with separate lock pins and lock motors. This simplifies the structure of the lock device 19.

(4) When the lifting of the lock arm 13 or the striker 20 activates the lock pin detection switch 46, the engagement pin 38 and the groove 42 are not properly engaged with each other, and the engagement pin 38 comes into contact with the guide slope 43. Here, the urging member 39 permits movement of the rack 37 toward the locking side. Then, the urging force of the urging member 39 lowers the lock pin 23 so that the engagement pin 38 consequently engages with the groove 42. In this manner, when the lock pin detection switch 46 detects that the lock pin 23 has been moved from the unlock position to the lock position by the locking subjects 3 and 9 and permits the supply of power to the lock motor 31, the engagement pin 38 is permitted to move back against the urging force of the second urging member when the groove 42 of the lock pin 23 is not properly engaged with the engagement pin 38 and moved forward by the urging force of the urging member 39 when the groove 42 of the lock pin 23 is aligned with the engagement pin 38. Thus, even when the lock pin detection switch 46 is activated and the engagement pin 38 and the groove 42 are not properly engaged with each other, the engagement pin 38 may consequently be engaged with the groove 42, and switch the lock device 19 to a lock state.

(5) The chamfered portions 45*a* and 45*b* arranged on the distal end of the lock pin 23 allows for the lock pin 23 to be smoothly lifted by the lock arm 13 or the striker 20.

It should be apparent to those skilled in the art that the present invention may be embodied in many other specific forms without departing from the spirit or scope of the invention. Particularly, it should be understood that the present invention may be embodied in the following forms.

The conditions for starting lid unlocking may be, for example, the operation of a predetermined button (switch) arranged in the vehicle or further pushing of the closed lid 3 when the electronic key system has accomplished ID verification. Further, the electronic key system is one example of wireless verification that performs ID verification (key verification) through wireless communication between a vehicle and an electronic key. For example, the electronic key system may be an operation-free key system that starts ID verification through narrow-band wireless communication (communication distance of several meters) in response to communication from a vehicle.

The condition for starting lid locking may be cooperation with door locking under the assumption that the lid 3 is closed. Further, the accomplishment of ID verification performed by the electronic key system may be included in the conditions for starting lid locking.

The condition for starting charge cable unlocking may be, for example, an unlocking operation performed on an operation switch dedicated for charge cable locking. Another condition for starting charge cable unlocking may be, for example, a plug connection detection signal, which is output from the plug connection detector 18 of the power plug 11, being input to the vehicle body 1 and the vehicle door undergoing an unlock operation (door unlocking cooperation).

The condition for starting charge cable locking may be, for example, a locking operation performed on an operation switch dedicated for charge cable locking. The operation switch may be arranged in the power port 2 or in the vehicle. Another condition for starting charge cable locking may be, for example, a plug connection detection signal, which is output from the plug connection detector 18 of the power plug 11, being input to the vehicle body 1 and the vehicle door undergoing an unlock operation (door locking cooperation).

The position detector does not have to be a contact switch and may be a contactless sensor.

The lifting position of the lock pin 23 that detects the lock pin detection switch 46 may be located at any location as long as the lifting of the lock pin 23 may be detected.

The motor circuit 48 may be independent from, for example, the circuit of the door lock motor 47.

The actuator of the lock device may be, for example, a solenoid instead of a motor.

The plug connection detector 18 may be a switch or sensor arranged at the side of the inlet 6. Further, the plug connection detector 18 may be of a contact type or a contactless type.

The lid 3 does not have to be opened by a torsion spring structure. For example, when the lid is further pushed from the close position, the lid 3 may be automatically opened by a push lifter.

During lid locking, the lock pin 23 may be engaged with a component other than the striker 20.

The lock device 19 does not have to be coupled to the upper portion of the lid box 5 and may be coupled to the lid box 5 at other locations such as the side portion.

The lock device 19 may be fastened together with the inlet 6 when coupled to the lid box 5 or coupled separately to the lid box 5 regardless of the inlet 6.

The lock device 19 may be switched to an unlock state by, for example, switching the trigger switch 22.

One of locking and unlocking of the lock device may be performed manually, and the other one of locking and unlocking may be performed automatically.

The lock device 19 may be dedicated for charge cable locking or for lid locking. Further, in broad terms, the lock device 19 only needs to be arranged in the power port 2.

The locking subject does not have to be the lid 3 or the charge cable 9 and may be any component related with the power port of a battery-powered vehicle.

The lock device 19 may have any structure as long as the urging member 25 constantly urges the lock pin 23 toward the locking side. For example, the lock member is not limited to a movable pin and may be a rotatable cylindrical pin member including a cutout portion. In this case, the lock arm 13 is fixed to a location free from the cutout portion, and the cutout portion allows for operation of the lock arm 13. Further, the lock member may be a triangular plate pivoted between a lock position and an unlock position.

The lock device 19 may have a structure that shifts to a lock state by directly engaging the lock pin 23 with the housing (main body portion) of the power plug 11.

The engaged portion of the lock member is not limited to a groove and may have any form such as a hole.

The lock device 19 does not have to be installed in a vehicle and may be applied to a different device or instrument.

The present examples and embodiments are to be considered as illustrative and not restrictive, and the invention is not to be limited to the details given herein, but may be modified within the scope and equivalence of the appended claims.

The invention claimed is:

1. A lock device for locking a locking subject, the lock device comprising:

a lock member that moves between a lock position where the lock member locks the locking subject and an unlock position where the lock member unlocks the locking subject;

a first urging member that constantly urges the lock member to the lock position;

a switching member that moves between a first position where the switch member fixes the lock member at the lock position and a second position where the switch member permits the lock member to unlock the locking subject;

a first actuator that drives the switching member; and a position detector arranged in a power supply line connected to the first actuator, wherein the position detector detects whether or not the lock member has been moved from the unlock position to the lock position by the locking subject and permits power to be supplied to the first actuator when detecting the movement.

2. The lock device according to claim 1, wherein the first actuator is connected in parallel to a second actuator that drives a device differing from the switch member.

3. The lock device according to claim 2, wherein the position detector is arranged between the first actuator and a connection point shared by the first actuator, the second actuator, and a power supply.

4. The lock device according to claim 1, wherein the locking subject is one of a charge cable and a lid that opens and closes a power port, and the lock member includes a distal portion engaged with one of the charge cable and the lid.

5. The lock device according to claim 1, wherein the switch member includes an engagement member that is fitted to the lock member in a removable manner, a support member that supports the engagement member, and a second urging member arranged in the support member to apply urging force to the engagement member;

the lock member includes an engaged portion that is fitted with the engagement member of the switch member;

under a situation in which the position detector detects that the lock member has been moved from the unlock position to the lock position by the locking subject and permits the supply of power to the first actuator, the engagement member is permitted to move back against the urging force of the second urging member when the engaged portion of the lock member is not properly engaged with the engagement member, and the engagement member is moved forward by the urging force of the second urging member when the engaged portion of the lock member is aligned with the engagement member.

6. The lock member according to claim 2, wherein the first actuator drives the switch member in cooperation with locking and unlocking of a door.

7. A lock system comprising:

a first locking subject including a first engagement portion;

a second locking subject including a second engagement portion; and a lock device including a lock member that moves between a lock position where the lock member locks one of the first and second locking subjects and an unlock position where the lock member unlocks the one of the first and second locking subjects, wherein the lock member includes an engaged portion selectively engaged with the first and second engagement portions of the first and second locking subjects, a first urging member that constantly urges the lock member to the lock position, a switching member that moves between a first position where the switch member fixes the lock member at the lock position and a second position where the switch member permits the lock member to unlock the one of the first and second locking subjects;

a first actuator that drives the switching member; and a position detector arranged in a power supply line connected to the first actuator, wherein the position detector detects whether or not the lock member has been moved from the unlock position to the lock position by the one of the first and second locking subjects and permits the supply of power to the first actuator when detecting the movement.

* * * * *